US006750768B2

(12) United States Patent
Yang et al.

(10) Patent No.: US 6,750,768 B2
(45) Date of Patent: Jun. 15, 2004

(54) EAS SYSTEM EMPLOYING PSEUDORANDOM CODING SYSTEM AND METHOD

(75) Inventors: Xiaohui Yang, Cupertino, CA (US); Arthur Fuss, Studio City, CA (US)

(73) Assignees: WG Security Products, Inc., San Jose, CA (US); EAS Sensor Sense, Van Nuys, CA (US)

( * ) Notice: Subject to any disclaimer, the term of this patent is extended or adjusted under 35 U.S.C. 154(b) by 0 days.

(21) Appl. No.: 10/235,167

(22) Filed: Sep. 4, 2002

(65) Prior Publication Data

US 2003/0231113 A1 Dec. 18, 2003

Related U.S. Application Data

(60) Provisional application No. 60/372,924, filed on Apr. 15, 2002.

(51) Int. Cl.[7] ..... G08B 13/14

(52) U.S. Cl. ..... 340/571; 340/568.1; 340/572.1; 340/572.4

(58) Field of Search ..... 340/571, 568.1, 340/572.1, 572.4, 572.5, 572.7; 235/382, 439, 449, 494

(56) References Cited

U.S. PATENT DOCUMENTS

| | | | | | |
|---|---|---|---|---|---|
| 4,215,342 | A | * | 7/1980 | Horowitz | 340/572.1 |
| 5,005,001 | A | * | 4/1991 | Cordery | 340/551 |
| 5,030,940 | A | | 7/1991 | Siikarla | 340/572.2 |
| 5,239,696 | A | | 8/1993 | Balch et al. | 455/127.1 |
| 5,463,376 | A | * | 10/1995 | Stoffer | 340/572.1 |
| 5,512,878 | A | * | 4/1996 | Balch et al. | 340/572.1 |
| 5,640,693 | A | | 6/1997 | Balch et al. | 455/127 |
| 5,673,024 | A | * | 9/1997 | Frederick et al. | 340/572.1 |
| 5,699,045 | A | * | 12/1997 | Frederick et al. | 340/555 |
| 5,737,241 | A | | 4/1998 | Accolla et al. | 340/541 |
| 5,793,289 | A | * | 8/1998 | Strzelec | 340/572.1 |
| 5,796,339 | A | | 8/1998 | Drew et al. | 340/572.3 |
| 5,844,485 | A | | 12/1998 | Ryan, Jr. | 340/572.1 |
| 5,894,270 | A | * | 4/1999 | Clancy et al. | 340/572.4 |
| 5,909,178 | A | | 6/1999 | Balch et al. | 340/572.4 |
| 5,955,951 | A | | 9/1999 | Wischerop et al. | 340/572.8 |
| 6,351,216 | B1 | * | 2/2002 | Frederick et al. | 340/572.4 |
| 6,356,197 | B1 | | 3/2002 | Patterson et al. | 340/572.1 |

* cited by examiner

*Primary Examiner*—Toan N. Pham
(74) *Attorney, Agent, or Firm*—Haverstock & Owens LLP

(57) ABSTRACT

According to the invention, a system and method of reducing noise interference in a way that employs pseudorandom coding. A transmitter and receiver are provided to send and receive a string of non-periodic pulses. The string of non-periodic pulses can be a sequence of pseudorandom codes. The random transmission of pulses in a non-periodic manner promotes a significant immunity to periodic interferences of constant noise operating in a surveillance area. The string of non-periodic pulses can be mutually spaced and binary, in the form of 0 or 1, and can include several bits per cycle to measure the mean and standard deviation of the string of non-periodic pulses received. A circuit is coupled to the transmitter and receiver for comparing the portion of the string of non-periodic pulses received with the string of non-periodic pulses transmitted; and whereby an alarm in triggered if the portion of the string of non-periodic pulses is above a threshold value.

23 Claims, 4 Drawing Sheets

EAS SYSTEM EMPLOYING PSEUDORANDOM CODING SYSTEM AND METHOD

RELATED APPLICATIONS

This patent application claims priority under 35 U.S.C. 119 (e) of the co-pending U.S. Provisional Patent Application, Serial No. 60/372,924 filed Apr. 15, 2002 and entitled "EAS SYSTEM EMPLOYING PSEUDORANDOM CODING." The Provisional Patent Application, Serial No. 60/372,924 filed Apr. 15, 2002, and entitled "EAS SYSTEM EMPLOYING PSEUDORANDOM CODING" is also hereby incorporated by reference.

FIELD OF THE INVENTION

The present invention relates to the field of electronic article surveillance (EAS) systems, and in particular, to reducing noise interference and probability of false alarm in constant noise environments.

BACKGROUND OF THE INVENTION

EAS systems are often referred to as anti-theft systems and function in essentially the following manner. An electronic marker or tag is attached to individual items of retail merchandise either in-store or during the manufacturing or packaging process. When a product is legitimately sold, the tags are removed or deactivated at the point of sale and the merchandise can leave the store without triggering an alarm. If, however, a thief attempts to exit the store with an item bearing the "live" electronic marker, an alarm is triggered.

A transmitter at a store exit sends out electromagnetic wave pulses. The transmitter's electromagnetic wave pulses trigger a resonator within any tag located in the transmitter's detection field. The tag that enters this detection field responds to this pulse by emitting a single frequency signal, much like a tuning fork. When a receiver, also located at the store exit, picks up this return frequency after a predetermined anticipated delay, an alarm is triggered.

All retail stores, however, are filled with electromagnetic noise that can negatively affect a system's performance and even produce a false alarm. The difference sources of noise include fluorescent lights, computers, neon signs, and vertical main lines among others. These noise sources actually emit noise themselves and can cause poor detection and false alarms. Some sources of noise are referred to as "periodic" interferences, since they occur at regular or constant intervals. When an EAS system is transmitting signals at regular or periodic intervals, there is a possibility that one or more of these periodic interferences will cause a false alarm. The EAS system failed to distinguish if the detected signal is that of an EAS tag or a noise source. In addition to periodic interferences, there are random sources of interference that do not occur at normal or regular intervals.

The prior art of the Ultra-Max® system of Sensormatic, Inc., is a well-known system recognized by the retail community and a trademark of Sensormatic. Although the Ultra-Max operates at a narrow frequency pulse at 58 kHz, the Ultra-Max transmitter transmits signals periodically into a surveillance area, where electronic tags could be located. Because the signals are transmitted periodically, versions of the Ultra-Max system are more vulnerable to periodic noise sources.

An improved EAS system is the Ultra-Post system of Sensormatic, Inc. This system, unlike the Ultra-Max system, employs a plurality of transmitting modes. Like the Ultra-Max system, this system initially transmits signals at regular or periodic intervals. But once the system detects the presence of a tag at a particular location in the area, the system switches into a second mode of operation, the verification transmitting mode. The system verifies whether what it is detecting is really a tag, and not noise. Even though it performs well in certain environments, the Ultra-Post system requires a skilled technician to tune the systems with software and a laptop. This can require several trips as the environment of electronic noise often changes in a retail mall and the system will need adjustment to accommodate the "new" environment.

What is needed is a system employing pseudorandom coding to prevent interferences from constant or periodic noise sources. A system that employs this vehicle and is constantly recalculating the environment will require less service visits and meet the needs of today's retailers.

SUMMARY OF THE INVENTION

A method of reducing noise interference, in accordance with an inventive arrangement comprises the steps of: a) transmitting a string of non-periodic pulses; b) receiving a portion of the string of non-periodic pulses; and c) triggering an alarm if the portion of the string of non-periodic pulses is above a threshold value.

In accordance with the present invention, a transmitter sends out electromagnetic wave pulses in a non-periodic manner. The transmitter's electromagnetic-wave pulses trigger a resonator within a marker (tag) that emits its own electromagnetic-wave signals similar to the signals coming in from the transmitter. A receiver processes the signals coming in from the tag and triggers an alarm if the received pulses are above a threshold value.

The string of non-periodic pulses can be a sequence of pseudorandom codes. The random transmitting sequence promotes a significant immunity to periodic interferences or constant noise operating in a surveillance area. The string of non-periodic pulses can also be mutually spaced and binary, in the form of 0 or 1, where 0 stands for null transmitting and 1 stands for valid transmitting. This string can also include several bits per cycle to measure the mean and standard deviation of the string of non-periodic pulses received.

The method can further include the step of recording the portion the portion of the string of non-periodic pulses. Alternatively, the method can further include the step of comparing the portion of the string of non-periodic pulses with the string of non-periodic pulses transmitted.

The method can further include the step of calculating a mean average and standard deviation of the string of non-periodic pulses received.

When the string of non-periodic pulses received is above a threshold value, which can be a predetermined number, the receiver will trigger an alarm. This predetermined number can be binary.

In an alternative embodiment of the present invention, a security system is provided that transmits a string of non-periodic pulses. A transmitter continuously transmits a string of non-periodic pulses, and a receiver receives at least a portion of the string of non-periodic pulses. The receiver triggers an alarm if the portion of the string of non-periodic pulses received is above a threshold.

As in the first inventive arrangement, the string of non-periodic pulses can be a sequence of random or pseudorandom codes; the string of non-periodic pulses can also be mutually spaced and binary, in the form of 0 or 1, where 0 stands for null transmitting and 1 stands for valid transmitting; and the string can also include several bits per cycle to measure the mean and standard deviation of the string of non-periodic pulses received.

The system can further include means for recording the portion of the string of non-periodic pulses. Alternatively, the system can further include means for comparing the portion of the string of non-periodic pulses with the string of non-periodic pulses transmitted.

The system can further include means for calculating a mean average and standard deviation of the string of non-periodic pulses received.

When the string of non-periodic pulses received is above a threshold value, which can be a predetermined number, the receiver will trigger an alarm. This predetermined number can be binary.

In a third aspect of the present invention, a security system is provided that transmits a string of non-periodic pulses. A transmitter continuously transmits a string of non-periodic pulses, and a receiver receives at least a portion of the string of non-periodic pulses. A circuit is coupled to the transmitter and receiver for comparing the portion of the string of non-periodic pulses with the string of non-periodic pulses transmitted; and whereby an alarm is triggered if the portion of the string of non-periodic pulses is above a threshold value.

In accordance with the preceding alterative, the string of non-periodic pulses can be a sequence of pseudorandom codes; the string of non-periodic pulses can also be mutually spaced and binary, in the form of 0 or 1, where 0 stands for null transmitting and 1 stands for valid transmitting; and the string can also include several bits per cycle to measure the mean and standard deviation of the string of non-periodic pulses received.

DETAILED DESCRIPTION OF THE PREFERRED EMBODIMENT

Figure 1:
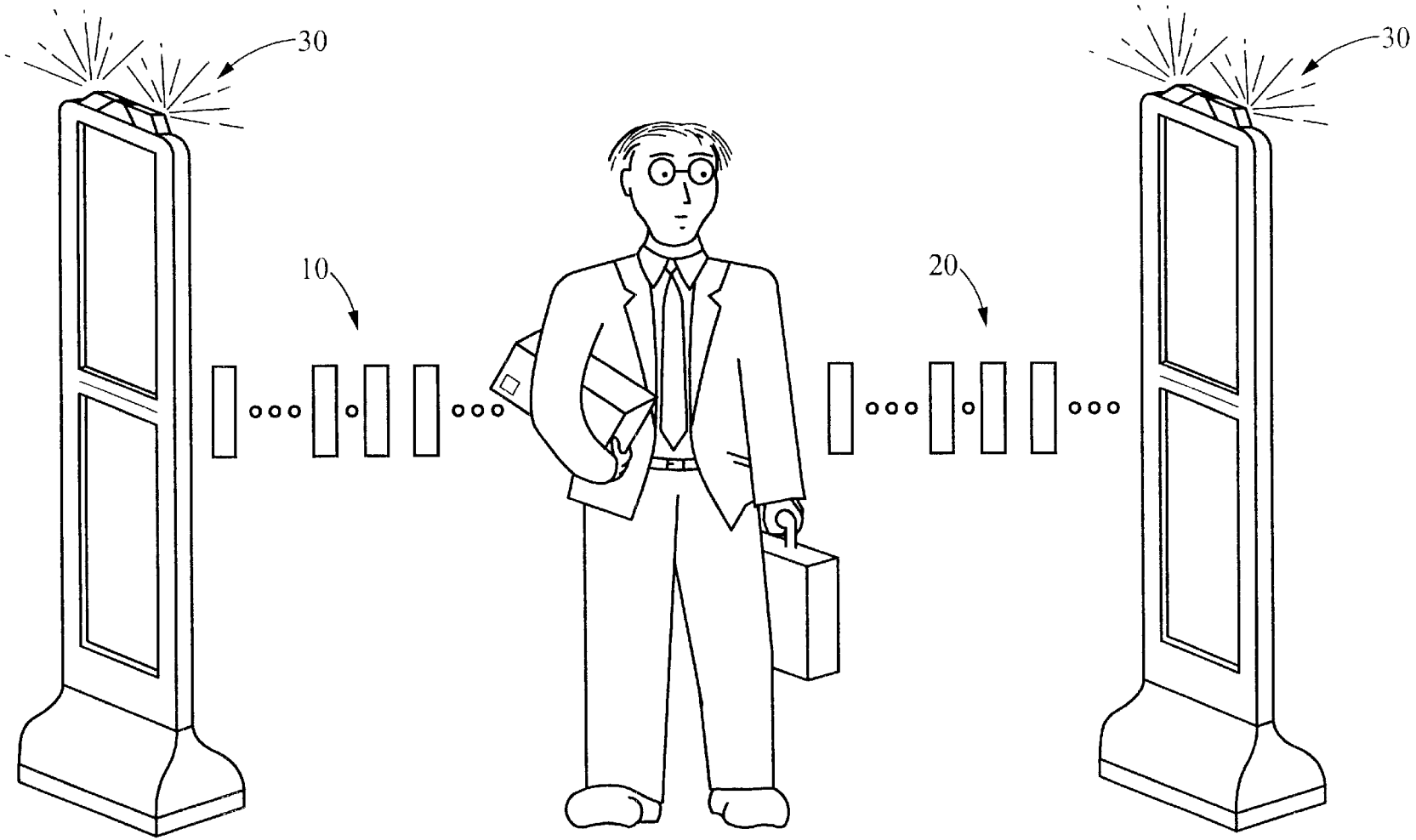
FIG. 1 shows a block diagram for an exemplary system for implementing the present invention.

Referring to FIG. 1, in one embodiment of the present invention, in the step 10, a transmitter located near the exit of a retail shop transmits non-periodic pulses into a surveillance area. The transmitter can be housed in pedestals placed at the store exit. A live anti-theft tag that enters the transmitter's (pedestals) detection field responds to the pulses with its own electromagnetic-wave signals similar to the non-periodic signals coming from the transmitter. When a receiver, also housed in pedestals located at the store exit, picks up this return frequency in the step 20, an audible alarm, in the step 30, is triggered on the pedestals, alerting staff to a potential theft incident.

The string of non-periodic pulses, in the step 10, may take the form of a sequence of pseudorandom codes, such as binary numbers, like 0 or 1, and where the sequence of pseudorandom codes is more than 6 bits per cycle and less than 12 bits per cycle. The spirit of this invention can also be achieved by transmitting a random sequence of pulses or by transmitting a predetermined non-regular sequence of pulses. By using at least 6 bits per cycle in the string of non-periodic pulses, in the step 20, is to produce a sampling size large enough to calculate a mean average and standard deviation of the string of non-periodic pulses received. Where the string of non-period pulses' sampling size is sufficiently large enough, the detected pulses, in the step 20, coming from a "live" tag appears as normally distributed or Gaussian noise at the receiver. However, the string of non-periodic pulses received, in the step 20, would first be recorded prior to calculating the mean and standard deviation. Then, the string of non-periodic pulses transmitted, in the step 10, can be compared to the received signals, and if the value of the portion received is above a certain threshold value, the system triggers an alarm. While using sensed signals to establish a mean and standard deviation provides improved performance, it will be understood that setting a predetermined threshold could also be used.

Figure 2:
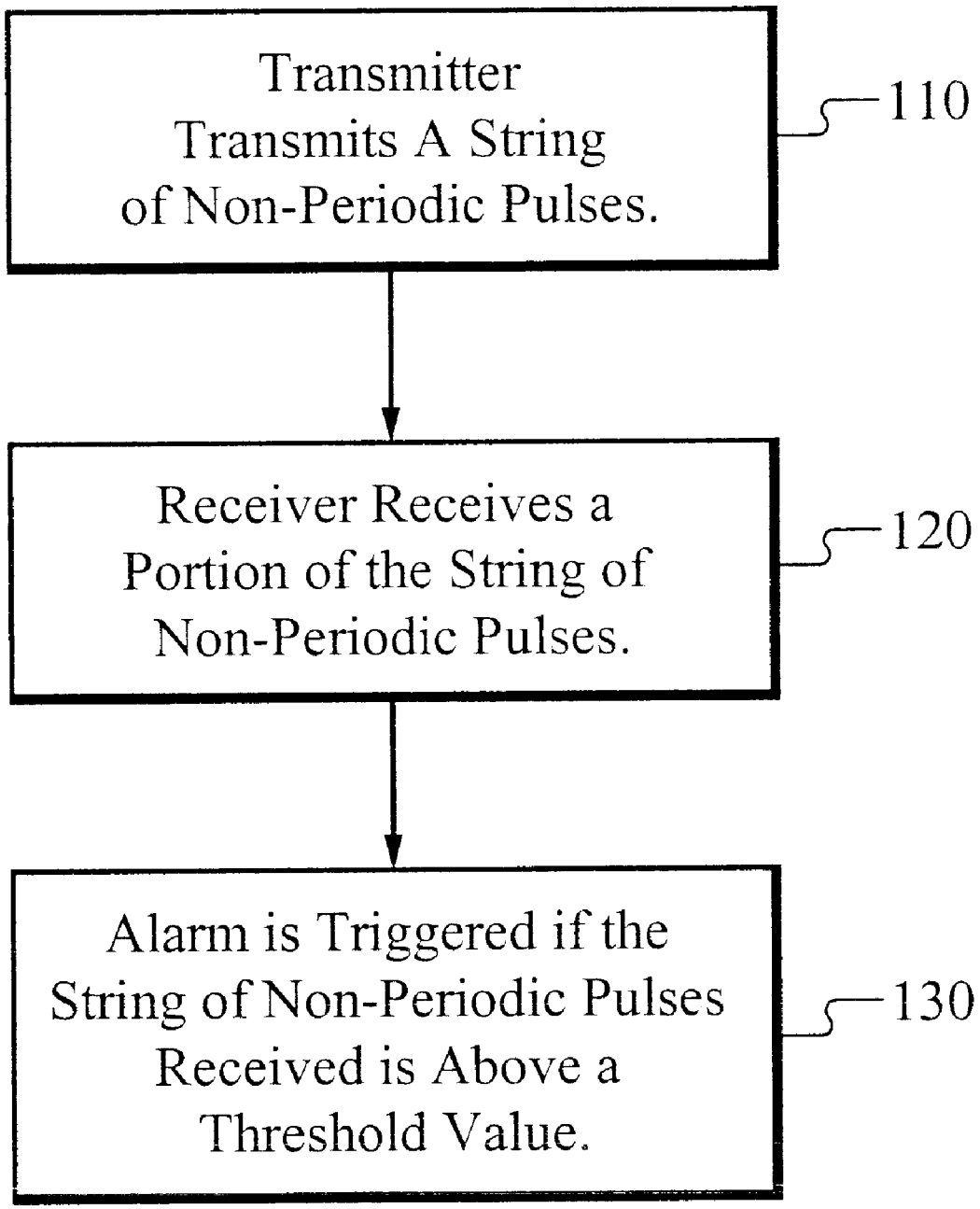
FIG. 2 illustrates a flow diagram of an EAS system employing pseudorandom coding.

FIG. 2 illustrates a flow diagram, similar in manner to FIG. 1, of an EAS system employing pseudorandom coding. In the Step 110, a transmitter transmits a string of non-periodic pulses. The string of non-periodic pulses can be a sequence of pseudorandom codes, such as binary numbers, like 0 or 1, in any combination, to promote a significant immunity to periodic interferences. The string of non-periodic pulses transmitted, in the Step 110, enters the transmitter's detection or surveillance field. A "live" anti-theft tag that enters this surveillance field responds to the pulses by emitting its own electromagnetic-wave signals similar to the signals coming from the transmitter. In the Step 120, a receiver receives or picks up the return signals. Using at least 6 bits per cycle in the string of non-periodic pulses produces a sampling size large enough to calculate a mean average and standard deviation of the string of non-periodic pulses received. Where the string of non-periodic pulses is sufficiently large enough to produce a reliable sampling size, the detected pulses coming from a "live" tag appears as normally distributed or Gaussian noise at the receiver. In the Step 130, if the portion of the string of non-periodic pulses is above a threshold value, an alarm is triggered. The string of non-periodic pulses received, in the step 120, can be compared to the string of non-periodic pulses transmitted prior to determining if the received string of non-periodic pulses is above the threshold value for triggering the alarm. The threshold value can be a predetermined number and binary, similar to binary numbers in the string of pseudorandom codes.

Figure 3:
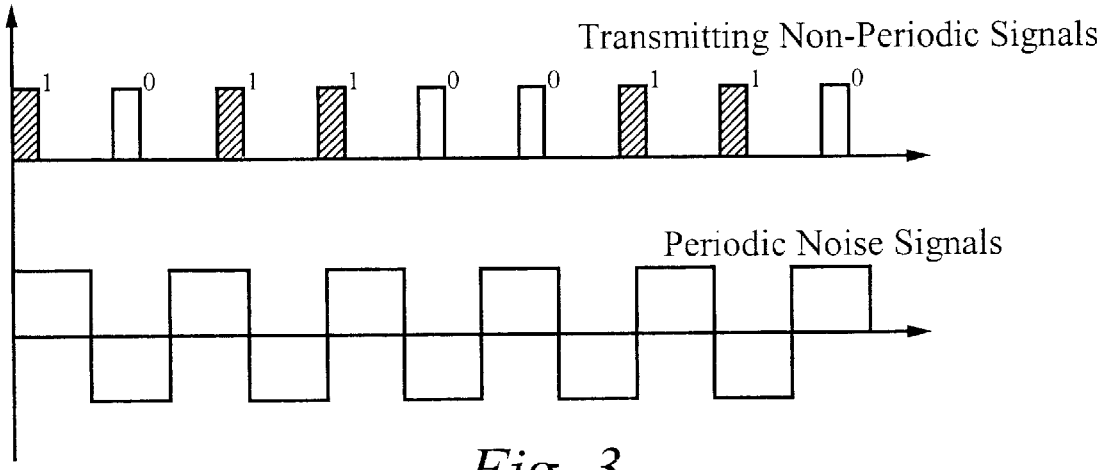
FIG. 3 illustrates the wave-form of a string of non-periodic pulses compared to the wave-form of periodic interferences or noise.

FIG. 3 illustrates the wave-form of a string of non-periodic pulses compared to the wave-form of periodic interferences. In FIG. 3, the bit value '1' stands for valid transmitting and the bit value '0' stands for null transmitting—where "valid transmitting" means an actual signal is being transmitted and "null transmitting" means no signal is being transmitted. The signals can be transmitted, as in FIG. 3, in mutually spaced intervals. As can be seen, the random transmitting sequence promotes a significant immunity to periodic noises. This reduces the probability of false alarm from random noise.

Figure 4:
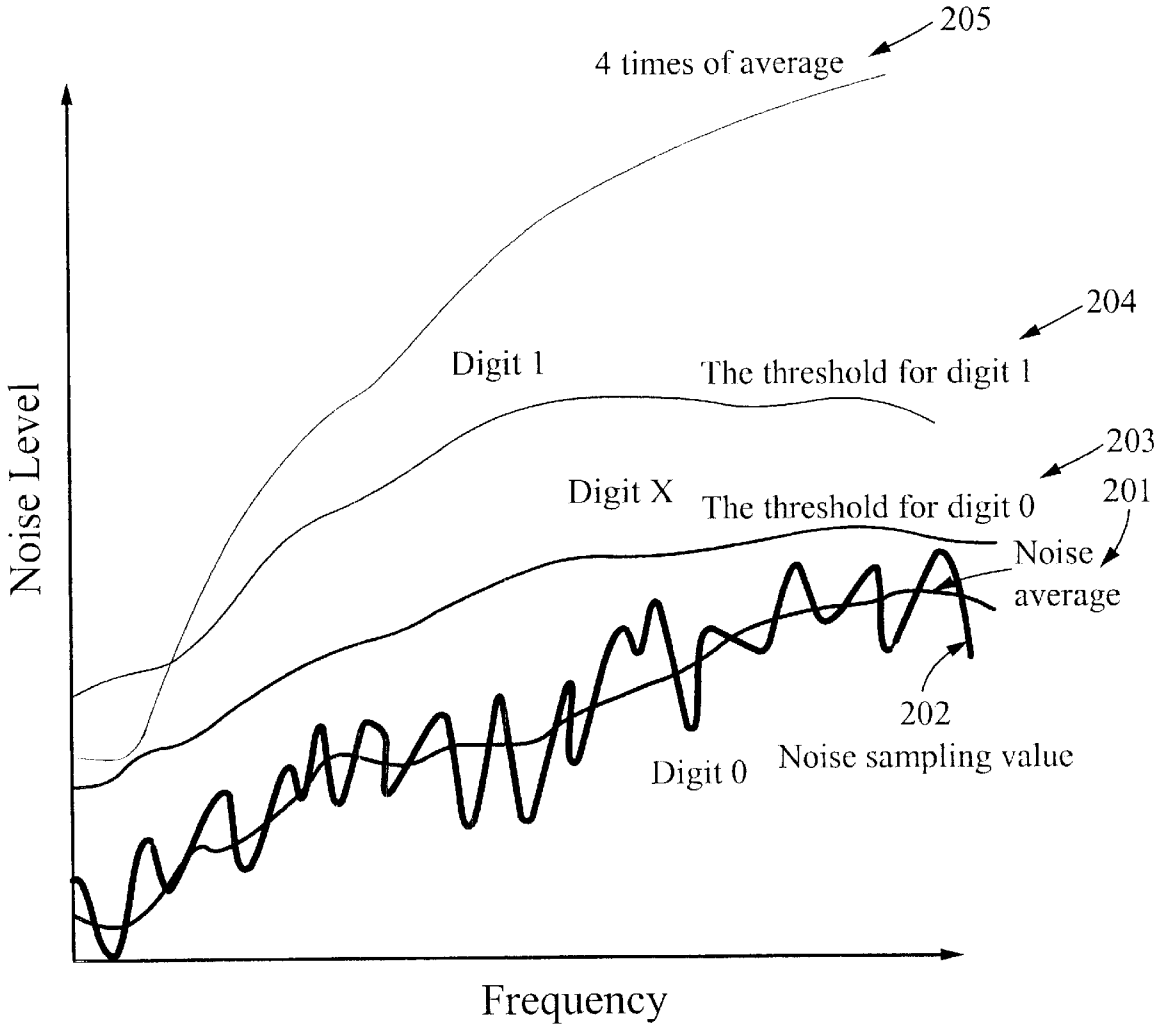
FIG. 4 illustrates graphically sample noise levels of the string of non-periodic pulses received with the method of FIG. 1.

FIG. 4 graphically illustrates sample noise levels of the string of non-periodic pulses received with the method of FIG. 1. In FIG. 4, the ordinate of the graph represents the noise level of the non-periodic pulses received or the noise sources detected and the abscissa represents the frequency of the pulses. As shown, the noise average 201 is the average value of the periodic noise sources (interferences) in the surveillance area. The noise sampling value 202 is the detected and calculated noise values of the periodic noise sources. Any detected signal that has a noise level less than the value representing the threshold for digit '0' 203 will be labeled a null or bit value '0' for comparison purposes. Any detected signal that has a noise level greater than the value representing the threshold for digit '1' 204 will be labeled a valid signal or bit value '1' for comparison purposes. Any detected signal that has a noise level less than the value representing the threshold for digit '1' 204 and greater than the value representing the threshold for digit '0' 203 will be labeled a 'X'. The label 'X' means the detected signal could be either a bit value '0' or a bit value '1'.

A sample implementation of the present invention, in accordance with FIG. 1 and FIG. 4, can be the following: A transmitter transmits a sequence of pseudorandom codes, as in the step 110, with 9 bits per cycle into a surveillance area, where each of the sequence of pseudorandom codes has an individual transmitting code in the form of bit value '0' or 1, as in FIG. 3 above. A receiver receives at least a portion of the sequence of pseudorandom codes, as in the step 120, wherein each of the received sequence of pseudorandom codes has an individual receiving value due to noise in the surveillance area. A circuit coupled to the transmitter and receiver calculates a mean average (m) and standard deviation (s) of the received sequence of pseudorandom codes.

The circuit converts the individual receiving value of the received sequence of pseudorandom codes to produce an individual receiver code in the form of bit value '0', '1', or 'X', as in FIG. 4, such that:

- if the individual receiving value is greater than or equal to the mean plus three times the standard deviation (m+3s), then the individual receiver code is 1;
- if the individual receiving value is less than the mean plus two times the standard deviation (m+2s), then the individual receiver code is 0;
- if the individual receiving value is less than the mean plus three times the standard deviation (m+3s) and greater than or equal to the mean value plus two times the standard deviation (m+3s), then the individual receiver code is X;

Then, the circuit compares each individual transmitting code with its corresponding individual receiver code to produce a final individual value, such that:

- if the individual transmitting code is 0 and the individual receiver code is 0, then the final individual value is 0;
- if the individual transmitting code is 0 and the individual receiver code is 1, then the final individual value is −2;
- if the individual transmitting code is 0 and the individual receiver code is X, then the final individual value is −1;
- if the individual transmitting code is 1 and the individual receiver code is 0, then the final individual value is −2;
- if the individual transmitting code is 1 and the individual receiver code is 1, then the final individual value is 1;
- if the individual transmitting code is 1 and the individual receiver code is X, then the final individual value is −1;

Then, the circuit adds the final individual values to produce a final overall value, such that:

- if the final overall value is greater than or equal to four 205, an alarm will trigger;
- if the final overall value is less than four 205, an alarm will not trigger;

The system can repeat the previous steps in the sample implementation continuously for normal security operations.

This invention has been described in terms of specific embodiment is incorporating details to facilitate the understanding of the principles of construction and operation of the invention. Such reference herein to specific embodiment and the details thereof is not intended to limit the scope of the claims and hereto. It will be apparent to those of ordinary skill in the art that modifications can be made in the embodiment chosen for illustration without departing from the spirit and scope of the invention. Specifically, it will be apparent to one of ordinary skill in the art device of the present invention could be implemented in several different ways and the apparatus disclosed above is only illustrative of the before embodiment invention and is in no way limitation.

What is claimed is:

1. A method of reducing noise interference, the method comprising the steps of:

a) transmitting a string of non-periodic pulses;

b) receiving a portion of the string of non-periodic pulses;

c) calculating a mean and standard deviation of the portion of the string of non-periodic pulses received:

d) comparing the portion of the string of non-periodic pulses received with the string of non-periodic pulses transmitted; and e) triggering an alarm if the portion of the string of non-periodic pulses received is above a threshold value.

2. The method of claim 1 wherein the string of non-periodic pulses is a sequence of pseudorandom codes.

3. The method of claim 1 wherein the string of non-periodic pulses is binary.

4. The method of claim 3 wherein the string of non-periodic pulses is more than 6 bits per cycle and less than 12 bits per cycle.

5. The method of claim 1 wherein the string of non-periodic pulses is mutually spaced.

6. The method of claim 1 further including the step of recording the portion of the string of non-periodic pulses.

7. The method of claim 1 wherein the threshold value is a predetermined number.

8. The method of claim 7 wherein the predetermined number is binary.

9. A security system, comprising:

a) means for transmitting a string of non-periodic pulses;

b) means for receiving a portion of the string of non-periodic pulses;

c) means for calculating a mean and standard deviation of the portion of the string of non-periodic pulses received;

d) means for comparing the portion of the string of non-periodic pulses received with the string of non-periodic pulses transmitted; and e) means for triggering an alarm if the portion of the string of non-periodic pulses is above a threshold value.

10. The system in accordance with claim 9, wherein the string of non-periodic pulses is a sequence of pseudorandom codes.

11. The system in accordance with claim 9, wherein the string of non-periodic pulses is binary.

12. The system in accordance with claim 11, wherein the string of non-periodic pulses is more than 6 bits per cycle and less than 12 bits per cycle.

13. The system in accordance with claim 9, wherein the string of non-periodic pulses is mutually spaced.

14. The system in accordance with claim 9, further including means for recording the portion of the string of non-periodic pulses.

15. The system in accordance with claim 9, wherein the threshold value is a predetermined number.

16. The system in accordance with claim 15, wherein the predetermined number is binary.

17. A security system, comprising:

a) a transmitter for transmitting a string of non-periodic pulses;

b) a receiver for receiving a portion of the string of non-periodic pulses; and c) a circuit coupled to the transmitter and the receiver for calculating a mean and standard deviation of the portion of the string of non-periodic pulses received and comparing the portion of the string of non-periodic pulses with the string of non-periodic pulses transmitted; and whereby an alarm is triggered if the portion of the string of non-periodic pulses is above a threshold value.

18. The system in accordance with claim 17, wherein the string of non-periodic pulses is a sequence of pseudorandom codes.

19. The system in accordance with claim 17, wherein the string of non-periodic pulses is binary.

20. The system in accordance with claim 19, wherein the string of non-periodic pulses is more than 6 bits per cycle and less than 12 bits per cycle.

21. The system in accordance with claim 17, wherein the string of non-periodic pulses is mutually spaced.

22. The system in accordance with claim 17, wherein the threshold value is a predetermined number.

23. The system in accordance with claim 22, wherein the predetermined number is binary.

* * * * *